US005250127A

United States Patent [19]

Hara

[11] Patent Number: 5,250,127

[45] Date of Patent: Oct. 5, 1993

[54] METHOD OF MANUFACTURE FOR SHIELDED FLAT ELECTRICAL CABLE

[75] Inventor: Ryoichi Hara, Narita, Japan

[73] Assignee: Fujikura Ltd., Tokyo, Japan

[21] Appl. No.: 671,362

[22] Filed: Mar. 19, 1991

[30] Foreign Application Priority Data

Sep. 20, 1988 [JP] Japan ..... 63-236115

[51] Int. Cl.[5] ..... H01B 13/26

[52] U.S. Cl. ..... 156/52; 156/247; 174/36; 174/117 FF

[58] Field of Search ..... 156/179, 247, 248, 344, 156/47, 51, 52, 73.1; 174/36, 117 FF, 117 F

[56] References Cited

U.S. PATENT DOCUMENTS

| | | | |
|---|---|---|---|
| 3,601,304 | 8/1971 | Mansour | 156/73.1 X |
| 3,610,506 | 10/1971 | Robinson | 156/73.1 X |
| 3,612,743 | 10/1971 | Angele et al. | 174/36 |
| 3,775,552 | 11/1973 | Schumacher | 174/117 F X |
| 4,513,170 | 4/1985 | Apodaca | 174/36 |
| 4,616,102 | 10/1986 | Noorily | 174/36 |
| 4,678,864 | 7/1987 | Cox | 174/36 |
| 4,695,679 | 9/1987 | Strauss et al. | 174/36 X |
| 4,698,457 | 10/1987 | Bordbar | 174/36 |
| 4,975,133 | 12/1990 | Gochermann | 156/73.1 |
| 5,003,126 | 3/1991 | Fujii et al. | 174/36 |

FOREIGN PATENT DOCUMENTS

| | | | |
|---|---|---|---|
| 2453941 | 5/1976 | Fed. Rep. of Germany | 174/117 F |
| 63-165719 | 10/1988 | Japan . | |
| 64-10913 | 1/1989 | Japan . | |
| 64-14813 | 1/1989 | Japan . | |
| 64-45008 | 2/1989 | Japan . | |
| 64-48311 | 2/1989 | Japan . | |
| 2-86010 | 2/1990 | Japan . | |
| 1086823 | 10/1967 | United Kingdom | 174/117 F |

*Primary Examiner*—Michael W. Ball
*Assistant Examiner*—Francis J. Lorin
*Attorney, Agent, or Firm*—Scully, Scott, Murphy & Presser

[57] ABSTRACT

A method of manufacturing shielded flat cable comprising a plurality of tape form conductors, arranged in a horizontal plane, and in parallel fashion, and insulation cladding which covers the surfaces of the conductors and is unitary in structure, and using a cladding cable which is formed by the placing of a tear-away wire, comprising materials having a greater physical strength than the insulation cladding, between at least one of the plurality of the conductors and the insulation cladding covering this conductor, in which, in the exposure of a conductor which is overlaid by the tear-away wire, the tear-away wire, along with the area of the insulation cladding which overlays this tear-away wire, is pulled in an angled direction with respect to the surface, and after this a shield layer comprising conductive materials and having a tape form is laid on the surface of the cladding cable and the shield layer is brought into electrical contact with the exposed conductor.

4 Claims, 10 Drawing Sheets 20
6
24
2
28
24
2
28
24
2
28

METHOD OF MANUFACTURE FOR SHIELDED FLAT ELECTRICAL CABLE

BACKGROUND OF THE INVENTION

1. Field of the Invention

The present invention relates to a manufacturing method for shielded flat electrical cable.

2. Background Art

Conventionally, thin flexible flat cable has been widely used in applications such as the cable connecting the printed circuit boards of electronic apparatuses. FIG. 1 shows an example of such conventional flat cable. Reference numerals 2 and 4 indicate conductors, both of which have rectangular cross sections and are formed of flexible metal. These conductors 2 and 4 are formed with standardized dimensions and of standardized materials and are arranged in a parallel fashion with a standard spacing therebetween. Furthermore, of theses conductors, conductors 2 are used as signal transmission lines, while conductor 4 is used as a grounding line. These conductors 2 and 4 are covered by means of an insulation cladding 6 comprising a resin having an electric insulation capacity. Insulation cladding 6 is formed around conductors 2 and 4 by the extrusion cladding of the resin in a heat-melted state.

There are cases in which this flat cable may need to be shielded from outside electromagnetic induction, or electrostatic induction, and to avoid the leakage of signals, depending on the conditions of use. In such a case, flat shielded cable is used which is provided with a shield layer 8 which is formed around insulation cladding 6 of the flat cables and comprises metal foil, a resin sheet to which metal has been laminated, or a metal wire grid (FIG. 2 shows an example of such a flat cable).

In such flat shielded cable, it is desirable to electrically connect the shield layer with the grounding line (conductor) 4 and thus equalize the electric potential thereof. In order to do this, the shield layer 8 is connected to grounding line (conductor) 4 at the end part thereof; however, if connection is made at the end part alone, cutting at this point of connection, or at an intermediate position along the shield layer, would cause the connection between the shield layer and the grounding line to be cut so that the shield effectiveness as a whole would be lost.

As a means to increase the reliability of the shield, it has been considered to connect grounding line (conductor) 4 and the shield layer along the entire length of the cable; however, in order to do this, it is necessary to peel off insulation cladding 6 on the surface of grounding line (conductor) 4.

However, an appropriate technique for the effective removal of insulation cladding 6 from the surface of grounding line 4, without affecting the surrounding insulation cladding 6 covering signal lines (conductors) 2 has not been known.

Furthermore, a further type of flat wire is known, in which, as shown in FIG. 3, there is a construction such that conductors 2 and 4 are sandwiched between an upper and lower pair of insulation tapes 10; however, in flat cable with this construction as well, a technique for the effective removal of insulation tape 10 covering grounding line 4 has not been known.

SUMMARY OF THE INVENTION

It is an object of the present invention to obtain a manufacturing method which will enable the effective removal of the insulator provided on the flat cable, and thus enable the reliable connection of the grounding line (conductor) and the shield layer.

In order to accomplish the above object, the present invention discloses a method of manufacturing shielded flat cable comprising a plurality of tape form conductors, arranged in a horizontal plane, and in parallel fashion, and insulation cladding which covers the surfaces of the conductors and is unitary in structure, and using a cladding cable which is formed by the placing of a tear-away wire, comprising materials having a greater physical strength than the insulation cladding, between at least one of the plurality of the conductors and the insulation cladding covering this conductor. The method discloses a process for the exposure of a conductor which is overlaid by the tear-away wire, in which the tear-away wire, along with the area of the insulation cladding which overlays this tear-away wire, is pulled in an angled direction with respect to the surface; and a process in which a shield layer comprising conductive materials and having a tape form is laid on the surface of the cladding cable and the shield layer is brought into electrical contact with the exposed conductor.

In accordance with this, the insulation cladding in the area covering a conductor which is to be used as a grounding line, is pulled off together with a tear-away wire having a greater physical strength than the insulation cladding, and by means of this, this is pulled away from the insulators of other areas, and the conductor which is to be used as a grounding line, is exposed. The shielding material is laid on top of the exposed conductor, and when the conductor and the shielding material touch, this establishes an electrical connection.

DETAILED DESCRIPTIONS OF THE PREFERRED EMBODIMENTS

Figure 1:
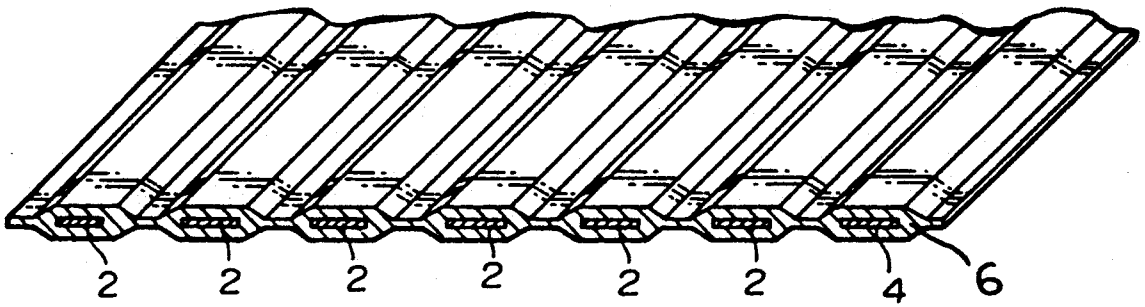
FIG. 1 (PRIOR ART)
FIG. 1 is an angled view showing a conventional type of flat cable.
Figure 2:
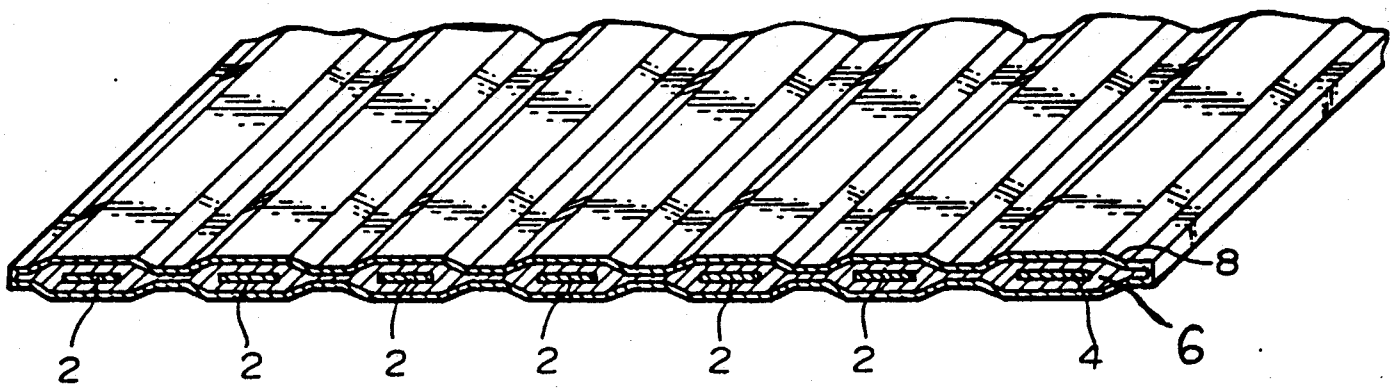
FIG.2 (PRIOR ART)
FIG. 2 is an angled view showing the flat cable of FIG. 1 with a shield provided thereon.
Figure 4:
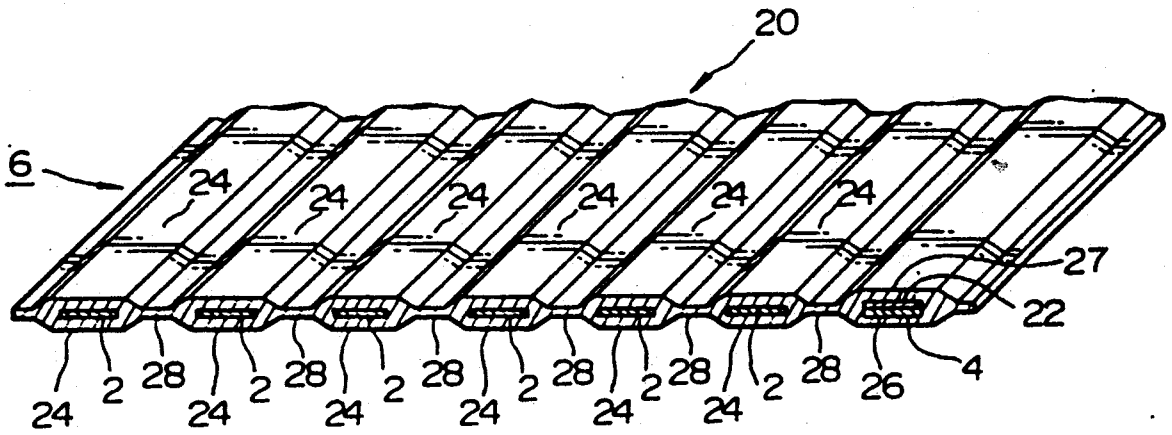
FIG. 4 is an angled view of flat cable which comprises a part of the shielded flat cable of the first preferred embodiment.

FIG. 4 is an angled view of flat cable 20 which comprises a part of the shielded flat cable of the first preferred embodiment of the present invention. This flat cable 20 has, like the flat cable shown in FIG. 1, conductors 2, 2, . . . , which are signal lines, and conductor 4 which is a grounding line. These conductors 2 and 4 have a rectangular cross section, are formed of a metal such as copper, or the like, and are formed in the shape of a tape. A tear-away wire 22 (which has the same shape and is made of the same materials as conductors 4 in this embodiment) overlays this conductor 4. The conductors 2, 2, . . . , 4 and the tear-away wire 22 are arranged in a parallel fashion, with spaces therebetween, and are encased therearound by insulation cladding 6 comprising a flexible electric insulator. It is necessary that the tear-away wire 22 have a greater tensile strength than insulation cladding 6; in the case of the present preferred embodiment, the tear-away wire is formed of the same metal and with the same shape as conductors 2 and 4. However, it is permissible to use other materials, for example, compound resins such as polyester resin, or metals such as steel. Furthermore, the thickness of tear-away wire 22 can be decreased below that of the preferred embodiment so long as the necessary tensile strength is maintained. The purpose of the rectangular cross section of conductors 2 and 4 is to minimize the change in cross sectional area in the case in which the flat cable is bent in the direction of the thickness thereof, and thus to minimize the change in the electrical resistance value which accompanies a change in cross sectional area.

Insulation cladding 6 comprises cladding area 24 which clads conductor 2, cladding area 26 which clads conductor 4, and tear-away wire 22 and bridge area 28 which connects cladding 24 and cladding 26. Bridge area 28 is thinner than cladding 24 and 26.

The flat cable 20 formed as above, is used in shielded flat cable by covering it with a shield layer comprising a conductor on the outer circumference of insulation cladding 6.

Next, the method of removing the insulation cladding from flat cable 20 and exposing the conductor will be explained with reference to FIGS. 5 through 8.

Figure 5:
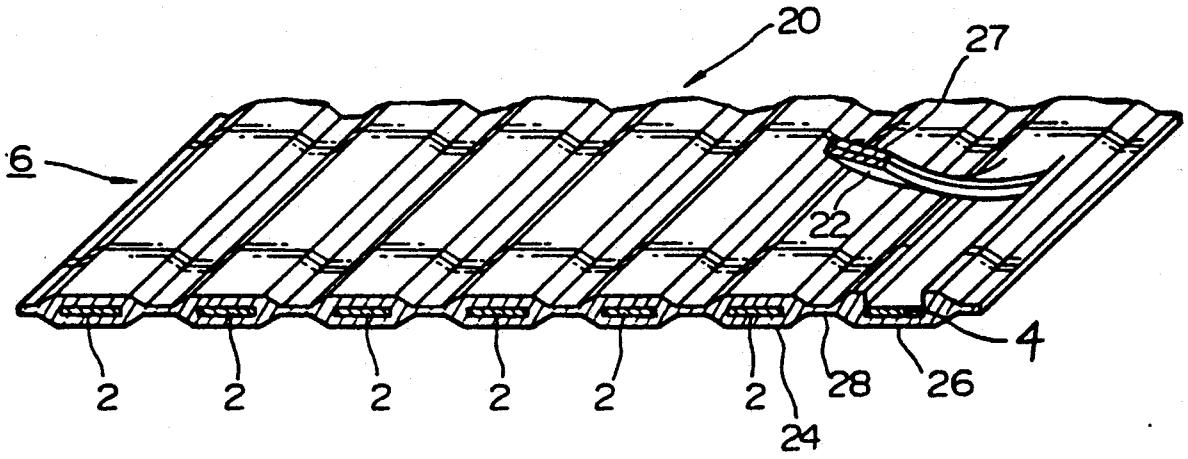
FIG. 5 is an angled view of the state in which a part of the shield layer of the flat cable of FIG. 4 is being removed.

1. First, as shown in FIG. 5, at one end (the beginning end) of flat cable 20, conductor 4 is exposed from one surface (in the Figures, the upper surface) of insulation cladding 6. Concretely, cladding layer piece 27 on the upper side of cladding 26 is pulled away with tear-away wire 22 to an appropriate length.

2. Next, flat cable 20 is placed in the peeling apparatus in FIG. 6. Reference A indicates the peeling apparatus. Peeling apparatus A has lower plate 30, supply reel 32, first take-up reel 34, and second take-up reel 36. Flat cable 20 is positioned on lower plate 30 and slides therealong. Passage hole 38 is formed in lower plate 30. As shown in FIG. 7, flat cable 20 is supported on supply reel 32 and wound therearound in such a way that the supply wheel is able to rotate. Second take-up reel 36 takes up the tear-away wire 22 and cladding layer piece 27 which are peeled off in (1) above the first take-up reel 34 takes up the parts of flat cable 20 in which conductor 4 is exposed. Passage hole 38 of lower plate 30 guides tear-away wire 22 and cladding layer 27 which overlays tear-away wire 22 which were peeled off, in a different direction from the other parts. Specifically, it guides tear-away wire 22 and cladding layer 27 in an angled direction (angled downward) with respect to the direction of movement of the other parts of flat cable 20 (the horizontal direction in FIG. 6). In order to position flat cable 20 on a peeling apparatus A with the above construction, first one end of flat cable 20 is affixed to supply reel 32 and wound therearound. Then, flat cable 20 is supplied from supply reel 32 and drawn in a sliding fashion above lower plate 30. Next, the other end of flat cable 20 is affixed the first take-up reel 34 and wound therearound. Furthermore, tear-away wire 22 and cladding layer 27 on the outside thereof, are both passed through hole 38 attached to the second take-up reel 36 which is located below and to the right of lower plate 30 and wound therearound.

In this state, first take-up reel 34 and second take-up reel 36 are synchronized and rotate in the direction of the arrow in the diagram. By means of this, flat cable 20 is supplied from supply reel 32, and flat cable 20 which contains all conductors 2, 2, . . . , 4 is taken up by first take-up reel 34, while tear-away wire 22 and cladding layer 27 are taken up by second take-up reel 36. In this way, tear-away wire 22 is peeled away from one surface of insulation cladding 6, and by means of this, cladding layer 27 is peeled away and removed from insulation cladding 6, which does not have as great a physical strength as tear-away wire 22. In this way, a part of insulation cladding 6 is peeled away along conductor 4 and a groove is formed, and at this place, conductor 4 is exposed.

Figure 9:
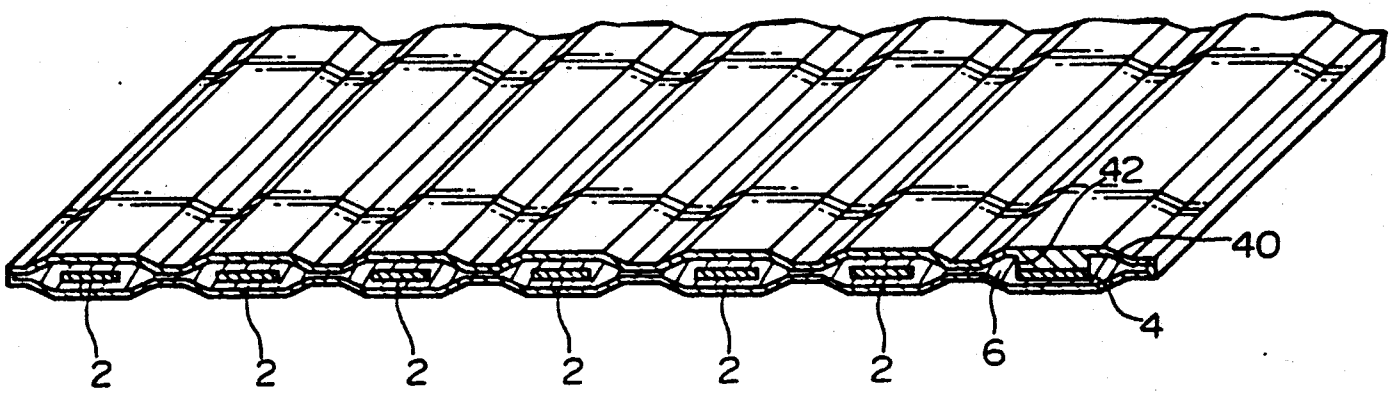
FIG. 9 is an angled view of the completed state of the shielded flat cable of the first preferred embodiment.

4. By continuing the rotation of take-up reels 34 and 36, tear-away wire 22 and cladding layer 27 are removed completely from insulation cladding 6 along the length of flat cable 20 and conductor 4 is exposed over its whole length. After this, the flat cable 20 which was taken up onto first take-up reel 34 is stretched out, and as shown in FIG. 9, a metal shield layer is laid on the outside of insulation cladding 6 and the shielded flat cable is completed. Shield layer 40 is laid on the outside of insulation cladding 6 so as to fill a groove 42 which was formed by the removal of tear-away wire 22 and cladding layer 27. In order to bring shield layer 40 into direct contact with conductor 4, a projecting part which has the same dimensions as those of groove 42 is provided on shield layer 40, or alternatively, shield layer 40 is forced in the direction of groove 42 and so formed that the interior of groove 42 is filled. By means of this, an electrical connection is made between the exposed conductor 4 and shield layer 40. In addition, it is permissible to place a insulator on the outside of shield layer 40 where necessary. In this preferred embodiment, conductor 4 and shield layer 40 are affixed in certain areas by using an adhesive agent. Furthermore, shield layer 40 and the surface of insulation layer 6 and conductor 4 are affixed by means of an adhesive agent which was applied in advance to the inner surface of shield layer 40. If the adhesive agent is applied over the whole surface, it will disturb the electrical contact between shield layer 40 and conductor 4, so that the area of application of the adhesive agent on shield layer 40 is restricted to a part of shield layer 40.

Figure 10:
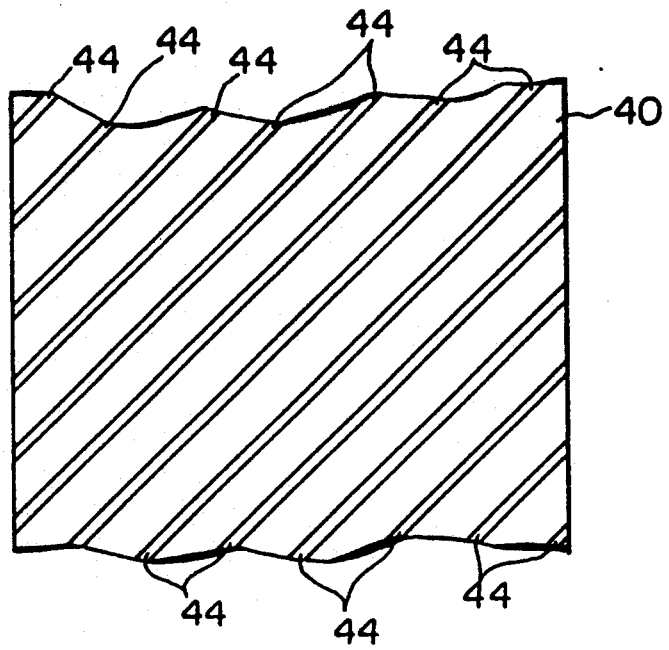
FIG. 10 is a plan view showing the application pattern of the adhesive agent of the shield layer of the first preferred embodiment.

An example of an application pattern of the adhesive agent is shown in FIG. 10. That is, adhesive agent 44 is applied in parallel straight lines running at an angle with respect to the lengthwise direction (shown by the arrow in the diagram) of shield layer 40.

In the shielded flat cable shown in FIG. 9, conductor 4 and shield layer 40 are electrically connected and serve as a grounding line so that conductor 4 is grounded and at the same time, shield layer 40 is grounded. In particular, by using the apparatus shown in FIGS. 6 to 8, it is possible to easily expose conductor 4. Furthermore, in the present preferred embodiment, tear-away wire 22 has the same width as conductor 4, so that by peeling away cladding layer 27 along with tear-away wire 22, the width of groove 42 is guaranteed, conductor 4 is exposed over a sufficiently wide area, and it is possible to increase the surface thereof which is in contact with shield layer 40.

Furthermore, in the above preferred embodiment, there are one of each of the grounded conductor 4 and the tear-away wire 22, however, this is not necessarily so limited; it is permissible to have however many are desired. Furthermore, by means of providing a plurality of tear-away wires 22, it is possible to expose a freely selected conductor and create a contact with shield layer 40. Accordingly, the degree of freedom in the decision of which of a plurality of conductors to choose as the grounding line, becomes high.

Figure 3:
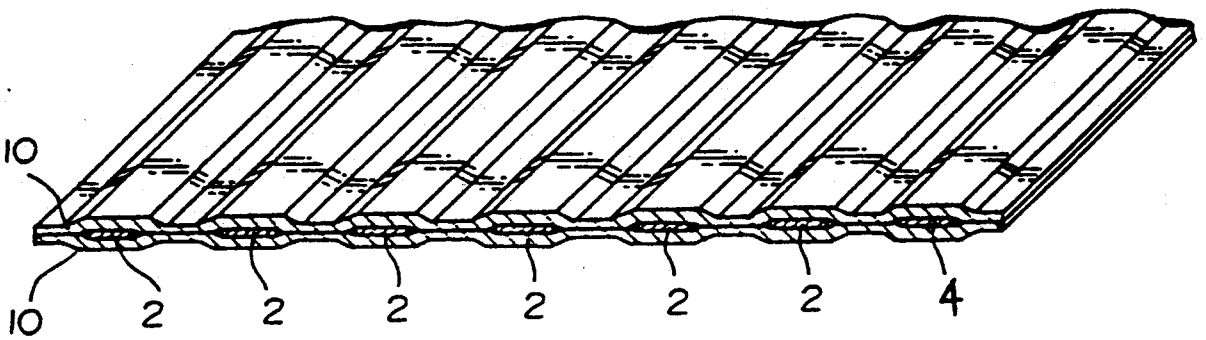
FIG. 3 (PRIOR ART)
FIG. 3 is an angled view showing another type of conventional flat cable.

In the above preferred embodiment, a case was explained in which cladding layer 6 was formed by extrusion molding; however, in the case in which a plurality of conductors is sandwiched between upper and lower layers of insulating tape (flat cable as shown in FIG. 3) it is possible to expose the conductor by means of an identical method.

Figure 6:
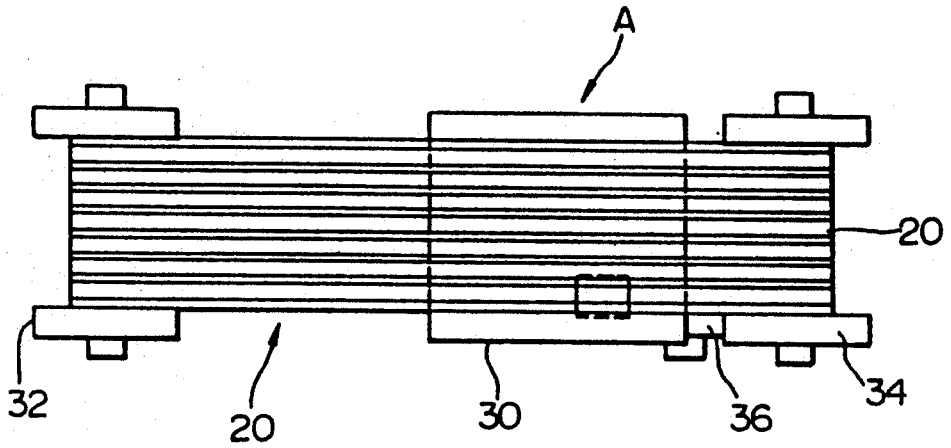
FIG. 6 is a top view of the apparatus which peels off the tear-away wire from the conductor in the first preferred embodiment.
Figure 7:
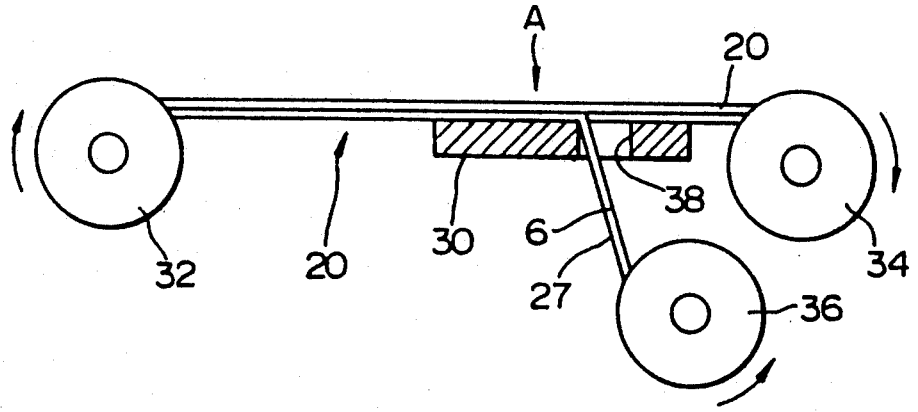
FIG. 7 is a side view of the apparatus in FIG. 6.
Figure 8:
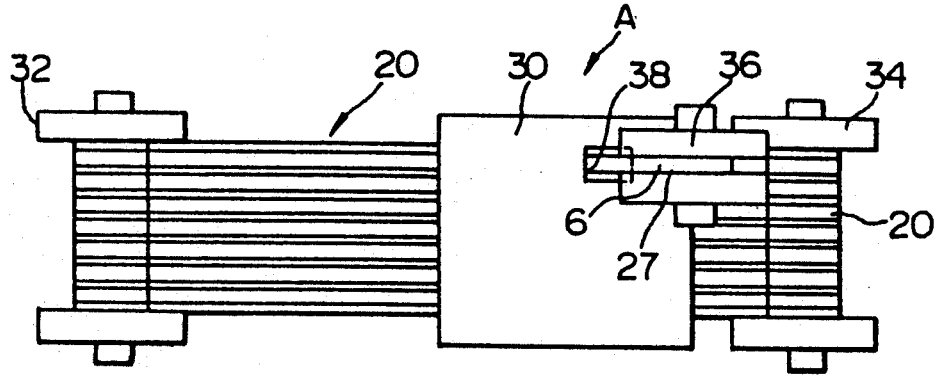
FIG. 8 is a bottom view of the apparatus of FIG. 6.
Figure 11:
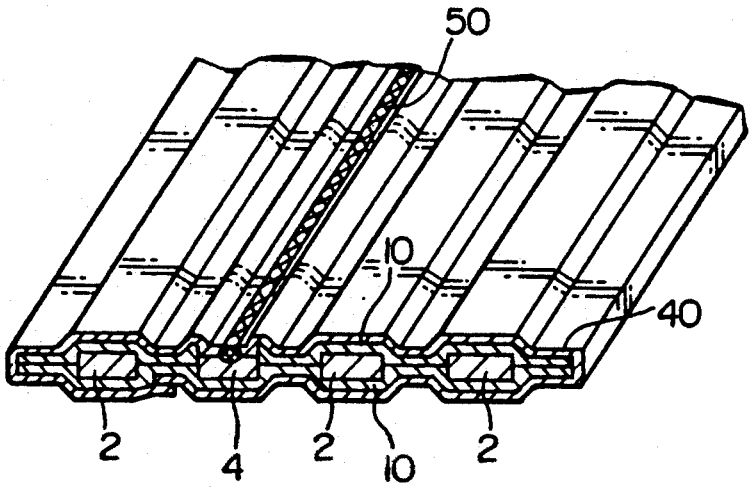
FIG. 11 is an angled view of the shielded flat cable of the second preferred embodiment.

FIG. 11 shows shielded flat cable according to a second preferred embodiment which utilizes flat cable in which the grounding line 4 is exposed by means of the apparatus shown in FIG. 6 through 8.

The shielded flat cable of the second preferred embodiment has a construction in which three (3) conductors 2 used as signal lines, and one (1) conductor 4 used as a grounding line, are arranged in a parallel fashion. These are sandwiched between upper and lower insulation tapes 10. The surface of these insulation tapes 10 is surrounded by a shield layer 40, and shield layer 40 is affixed to conductor 4 by means of welded part 50.

It is possible to construct the shielded flat cable of the above construction according to the process described hereinafter.

First, conductors 2 and 4, which have been arranged in the same horizontal plane, are sandwiched between insulation tapes 10 and passed between a pair of rollers (not shown in the Figure). By means of the addition of heat and pressure, this adheres together, and then an apparatus such as that already described is used, a part of insulation tape 10 is removed, and conductor 4 is exposed.

Next, a shield layer 40, to which an adhesive agent has been applied in the pattern shown in FIG. 10, is wrapped around insulation tape 10 with the adhesive layer to the inside, and then passed through a pair of rollers. Here, by means of the application of heat and pressure, the adhesive layer melts, and adhesion is achieved. Then, ultrasonic vibration is carried out on shield layer 40 at the part positioned on the surface of conductor 4 which forms the grounding line, and the surface of conductor 4 and shield layer 40 are ultrasonically seam-welded over the entire length thereof. It is possible to use an ultrasonic welding apparatus 60 such as that shown in FIG. 12 in this ultrasonic welding. This ultrasonic welding apparatus 60 comprises a vibrating element 64 which is vibrated by means of an ultrasonic vibration generator 62, a fixed platform 68 having a work-support surface 66 on the upper part thereof, a processing surface 70 which faces the support surface provided at the top of fixed platform 68, and a tool 74 which is energized in a downward direction by means of the load of weight 72, and receives the vibration of the vibrating element 64 and vibrates in a horizontal direction.

By using this apparatus, and proceeding in the method below, it is possible to easily conduct the welding described above.

Figure 12:
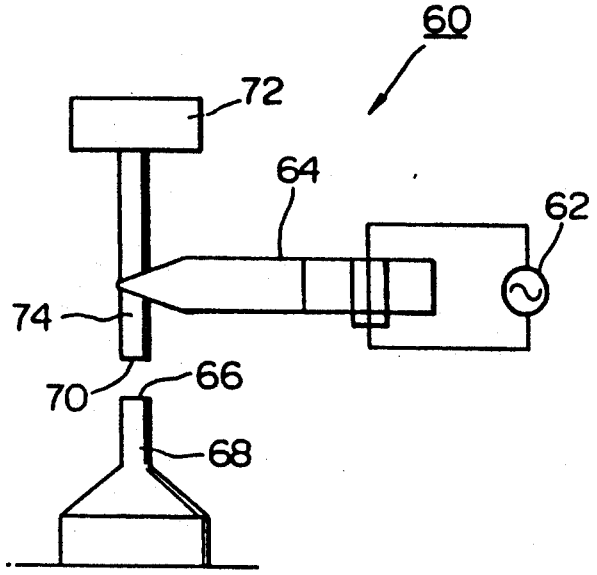
FIG. 12 is a side view of the ultrasonic welding apparatus used in the construction of the shielded flat cable of the second preferred embodiment.
Figure 13:
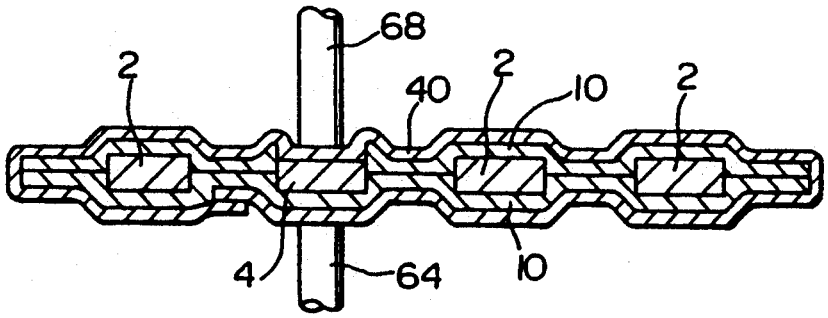
FIG. 13 is a horizontal cross section of the shielded flat cable of the second preferred embodiment at the time of welding.

That is, as shown in FIG. 12, tool 74 is placed in contact with the surface of conductor 4 on the shield layer, and by means of weight 72 a load is placed on shield layer 40 and it is pressed into contact with the surface of conductor 4. In addition, it is optimal to change the contact position of tool 74 in the lengthwise direction of shield layer 40 (in FIG. 13, a direction perpendicular to the page) at a fixed relative speed while vibrating ultrasonic vibration generator 62 and thus vibrating tool 74 in a horizontal direction.

At this time, the metal surface of shield layer 40 and the surface of conductor 4 are welded together in an extremely strong fashion by means of the ultrasonic vibrations from tool 68 and by means of the two steps below. A single welded part 50 is formed in which the welded surface is expanded, and the welding is uniform in the lengthwise direction thereof.

First Step

By means of the friction caused by vibration, the welding surfaces are cleaned, oxidized surface layers or impurities of the welded surfaces are removed and smoothed, and welding begins. In this step, the adhesive agent on the surface of shield layer 40, which is between the welded surfaces, is removed.

Second Step

Complex plastic flow takes place, and the welded surfaces expand and conductor 4 and shield layer 40 are welded together.

Shielded flat cable constructed in this manner has the following characteristics. That is, shield layer 40 and conductor 4 which serves as a grounding line, are electrically connected by welded part 50 which is formed over the entire length thereof, and by means of the fusion resulting from the plastic flow of the metal which forms shield layer 40 and the conductor 4, welded part 50 becomes uniform in the lengthwise direction thereof. As a result, in comparison with the conventional shielded flat cable in which the shield layer and the conductor were merely in contact, this type of contact is markedly more solid and even if bent, stress will not be caused, and the separation of shield layer 40, or the damaging of the conductor, is unlikely to occur.

Furthermore, in the case of the present preferred embodiment, ultrasonic vibration is used for the welding of shield layer 40 and conductor 4 and layers in the welded part, other than the metal layer forming shield layer 40, are removed in the first step of welding, so that layers other than the metal layer forming shield layer 40 (for example, an adhesive layer) are excluded from the welded part, so that there is no need to perform a separate separation process. Furthermore, in the case in which the shield layer has a construction in which an insulation layer covers the shielding metal layer, there is also no need to conduct a special separation, or the like. It is acceptable if the work support surface 66 and the processing surface 70 make contact with the shield layer 40 on the opposite side thereof from that shown in FIG. 13.

The application pattern of the adhesive agent of shield layer 40 is not limited to that shown in FIG. 10. In a case in which a strengthening of the adhesive force is required, it is effective to apply the adhesive agent over the whole surface, while in the case in which higher flexibility is required, it is advantageous to apply the adhesive agent in certain places only, so that the adjustment of the application surface is made in response to the required characteristics.

Figure 14:
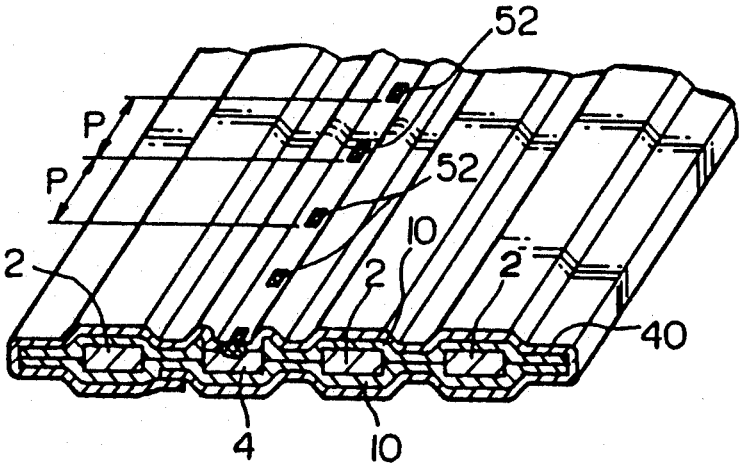
FIG. 14 is an angled view of the shielded flat cable of the third preferred embodiment.

FIG. 14 is an angled view of flat cable in accordance with a third preferred embodiment of the present invention.

This flat cable comprises, like the flat cable shown in the first and second preferred embodiments above, conductors 2 and 4, insulation tape 10 and shield layer 40. The part of one insulation tape 10 which is positioned on the surface of conductor 4, which serves as the grounding line, is separated therefrom along the entire length thereof by the use of an apparatus such as that shown, for example, in FIGS. 6 through 8. The surface of this conductor 4 and shield layer 40 are spot welded at certain points having a fixed spacing P, by means of ultrasonic welding. Reference numeral 52 indicates welded portions formed by the fusion of the metal forming shield layer 40 and the metal forming conductor 4.

Here, it is desirable that spacing P be sufficiently small. For example, in a case in which the smallest radius of bend, when the flat cable is used in a bent manner, is R, it is desirable that spacing P be significantly smaller than R. However, as not all of the spot welded parts will be used in a bent state, the spacing may be altered in accordance with the conditions of use.

Furthermore, in the case of the present embodiment, the weld of shield layer 40 and conductor 4 is carried out by means of welding using ultrasonic vibration, and layers other than the metal layer comprising shield layer 40 are removed in the initial step of welding, so that there is no need to conduct a separation process, or the like, in order to remove layers other than the metal layer comprising shield layer 40 from the welded part. That is, in the case of the above preferred embodiment, there is no need to remove the adhesive layer of shield layer 40, and furthermore, if the shield layer consists of a metal layer covered by an insulation layer, there is also no need to conduct a separation process, or the like, and flat cable having identical characteristics to those of the above flat cable can be realized.

The spot welds of shield layer 40 and conductor 4 must be so created that no tension is placed on shield layer 40 in the space between welded parts 52 which adjoin each other. Accordingly, it is preferable to conduct the welding in a state in which no tension is placed on shield layer 40 between welded parts 52 or in a state in which shield layer 40 is actually slack. By proceeding in this manner, even if the flat cable is bent, it is unlikely that great tension will be produced in shield layer 40 between adjoining welded parts 52. Therefore, it is unlikely that these welds will separate as a result of bending, and the ability of the flat cable to withstand bending will improve.

In the case in which the flat cable is not subjected to bending, it is possible to raise the efficiency of production by reducing the number of welding points (by increasing the spacing).

The lowest limit for the welding points in one flat cable is one point.

Furthermore, it is also acceptable to make contact between shield layer 40 and conductor 4 using resistance welding in place of the ultrasonic welding used in the preferred embodiment above. That is, an electric pole is attached to an end part, or the like, of conductor 4, and another electric pole is pressed onto shield layer 40 at certain points, and thereby the surfaces of conductor 4 and shield layer 40 which are in contact, are heated and thus welded together.

Furthermore, in the preferred embodiment above, the present invention is applied to flat cable (that is, tape cable) manufactured by the pressing together of insulation tape; however, this is not necessarily so limited, flat cable made by an extrusion-covering process is also acceptable.

Furthermore, in the above preferred embodiment, the present invention is applied to flat cables with the construction in which insulation tape is pressed together; however this is not necessarily so limited. Flat cable formed by means of the extrusion of an insulation layer is also acceptable.

What is claimed is:

1. A method for manufacturing a shielded flat cable from a cladding cable having:

a plurality of parallel conductors of a tape-form arranged horizontally;

an insulating cladding which covers the surface of the conductors and joins the conductors, the cladding having a unitary structure; and at least one tear-away wire having greater physical strength than the insulating cladding disposed in a direction parallel with the conductors, said wire being placed between at least one conductor and the insulating cladding which covers the conductors;

said method comprising the steps of:

exposing a conductor which is overlaid by a tear-away wire by pulling said tear-away wire in a direction away from the conductor being exposed, so as to cause a portion of the insulating cladding which overlays said tear-away wire to be torn away from an adjacent intact cladding layer, thereby exposing a length of the conductor surface in direct proportion to the length of the wire torn away; and laying an electrically conductive shield layer in the form of a tape on an exposed surface of the conductor;

bonding the shield layer to the exposed surface of the conductor so as to establish an electrically conducting bonded interface in a longitudinal direction of the exposed surface of the conductor.

2. The method of manufacturing a shielded flat cable in accordance with claim 1, wherein the tear away wire overlays one conductor.

3. The method of manufacturing a shielded flat cable in accordance with claim 1, wherein each conductor is overlaid by a corresponding tear-away wire.

4. The method of manufacturing a shielded flat cable in accordance with claim 1, wherein during the step of exposing the surface of at least one conductor, while the cladding cable is moving along one side of a board which has a passage hole, the tear-away wire is moving through the passage hole from one side of the board to another side of the board, along with a portion of the insulation cladding which overlays the tear-away wire.

* * * * *